US010261463B2

(12) United States Patent
Kawamura et al.

(10) Patent No.: US 10,261,463 B2
(45) Date of Patent: Apr. 16, 2019

(54) IMAGE FORMING APPARATUS

(71) Applicant: CANON KABUSHIKI KAISHA, Tokyo (JP)

(72) Inventors: Tomofumi Kawamura, Suntou-gun (JP); Shoichi Zensai, Yokohama (JP); Takashi Yano, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/005,462

(22) Filed: Jun. 11, 2018

(65) Prior Publication Data

US 2018/0292781 A1 Oct. 11, 2018

Related U.S. Application Data

(63) Continuation of application No. 15/453,570, filed on Mar. 8, 2017, now Pat. No. 10,018,959.

(30) Foreign Application Priority Data

Mar. 11, 2016 (JP) ..... 2016-048859
Feb. 14, 2017 (JP) ..... 2017-025411

(51) Int. Cl.
*G03G 21/16* (2006.01)
*G03G 21/18* (2006.01)

(52) U.S. Cl.
CPC ..... *G03G 21/1647* (2013.01); *G03G 21/1633* (2013.01); *G03G 21/1676* (2013.01); *G03G 21/1842* (2013.01); *G03G 21/185* (2013.01); *G03G 2215/0132* (2013.01); *G03G 2221/1684* (2013.01)

(58) Field of Classification Search
CPC ..... G03G 21/1647; G03G 21/1676
See application file for complete search history.

(56) References Cited

U.S. PATENT DOCUMENTS 8,238,787 B2 * 8/2012 Tani ..... G03G 21/1825 399/111
9,389,584 B2 * 7/2016 Uchida ..... G03G 21/1853
2007/0071495 A1 * 3/2007 Hashimoto ..... G03G 21/1821 399/111

* cited by examiner

*Primary Examiner* — Gregory H Curran
(74) *Attorney, Agent, or Firm* — Canon U.S.A., Inc. I.P. Division

(57) ABSTRACT

An image forming apparatus includes a mounting unit configured to mount a cartridge including a developing member by moving the cartridge in the insertion direction, and a pressing member having a first pressing portion configured to press the cartridge mounted on the mounting unit to separate the developing member from a photosensitive member. The pressing member has a second pressing portion configured to press the cartridge mounted on the mounting unit to bring the developing member into contact with the photosensitive member, and the first pressing portion and the second pressing portion integrally moves with the movement of the pressing member. The image forming apparatus also includes an elastic member configured to press the pressing member so that the second pressing portion presses the cartridge.

23 Claims, 18 Drawing Sheets

IMAGE FORMING APPARATUS

CROSS-REFERENCE TO RELATED APPLICATIONS

This application is a continuation, and claims the benefit, of U.S. patent application Ser. No. 15/453,570, presently pending and filed on Mar. 8, 2017, and claims the benefit of, and priority to, Japanese Patent Application No. 2016-048859, filed Mar. 11, 2016, and No. 2017-025411, filed Feb. 14, 2017, which are hereby incorporated by reference herein in their entireties.

BACKGROUND OF THE INVENTION

Field of the Invention

The present disclosure generally relates to an image forming apparatus, such as a copying machine, a printer, and a facsimile machine, in which an exterior cover is opened and closed to remove and replace a process cartridge mounted inside the apparatus.

Description of the Related Art

In a certain configuration of an image forming apparatus, an image bearing member (photosensitive drum) with a toner image formed thereon and an image forming unit (developing roller) are configured as a cartridge mountable on and removable from an image forming apparatus main body (apparatus main body) so that the replacement of consumables and other maintenance works can be easily performed.

In such cartridges, there is a contact development type in which development is performed by bringing the photosensitive drum into contact with the developing roller at the time of image formation. In a configuration discussed in Japanese Patent Application Laid-Open No. 2007-213025, to maintain a state where a photosensitive drum and a developing roller are in contact with each other, the developing roller is urged by an elastic member, disposed between a development unit and a drum unit of the cartridge respectively including the developing roller and the photosensitive drum, so that the developing roller comes into contact with the photosensitive drum. When the developing roller is separated from the photosensitive drum, the developing roller is moved to separate from the photosensitive drum by pressing the cartridge with a pressing member provided in the apparatus main body, and this state is maintained.

However, according to the configuration discussed in Japanese Patent Application Laid-Open No. 2007-213025 in which the developing roller is urged to come into contact with the photosensitive drum by the elastic member provided in the cartridge, it is necessary to provide an elastic member for generating an urging force in the cartridge. As a result, the size of the cartridge is increased. In a state where no cartridge is mounted on the apparatus main body, the developing roller is urged by the elastic member to come into contact with the photosensitive drum. Therefore, if this state is maintained for a long period of time, the frame of the cartridge, the developing roller, and the photosensitive drum may possibly be deformed. Therefore, in such a configuration, there is required a certain measure such as providing a member for restricting deformation in a state where no cartridge is mounted on the apparatus main body.

When the development unit and the drum unit are configured as different cartridges so that they can be separately mounted on and removed from the apparatus main body, it is basically difficult to provide an elastic member between the development unit and the drum unit.

SUMMARY OF THE INVENTION

The present disclosure generally relates to an image forming apparatus having a further advanced version of the above-described technique. More specifically, the present disclosure is directed to, even with a cartridge not having an elastic member for bringing a developing member (developing roller) into contact with a photosensitive member (photosensitive drum), the provision of a configuration for bringing the developing member into contact with the photosensitive member and separating the developing member from the photosensitive member.

According to an aspect of the present disclosure, an image forming apparatus includes a mounting unit configured to mount a cartridge including a developing member by moving the cartridge in an insertion direction, a pressing member having a first pressing portion configured to press the cartridge mounted on the mounting unit to separate the developing member from a photosensitive member and a second pressing portion configured to press the cartridge mounted on the mounting unit to bring the developing member into contact with the photosensitive member, the first and the second pressing portions integrally moving with a movement of the pressing member, and an elastic member configured to press the pressing member so that the second pressing portion presses the cartridge.

Further features of the present disclosure will become apparent from the following description of exemplary embodiments with reference to the attached drawings.

DESCRIPTION OF THE EMBODIMENTS

<Overall Configuration of Image Forming Apparatus>

Figure 1:
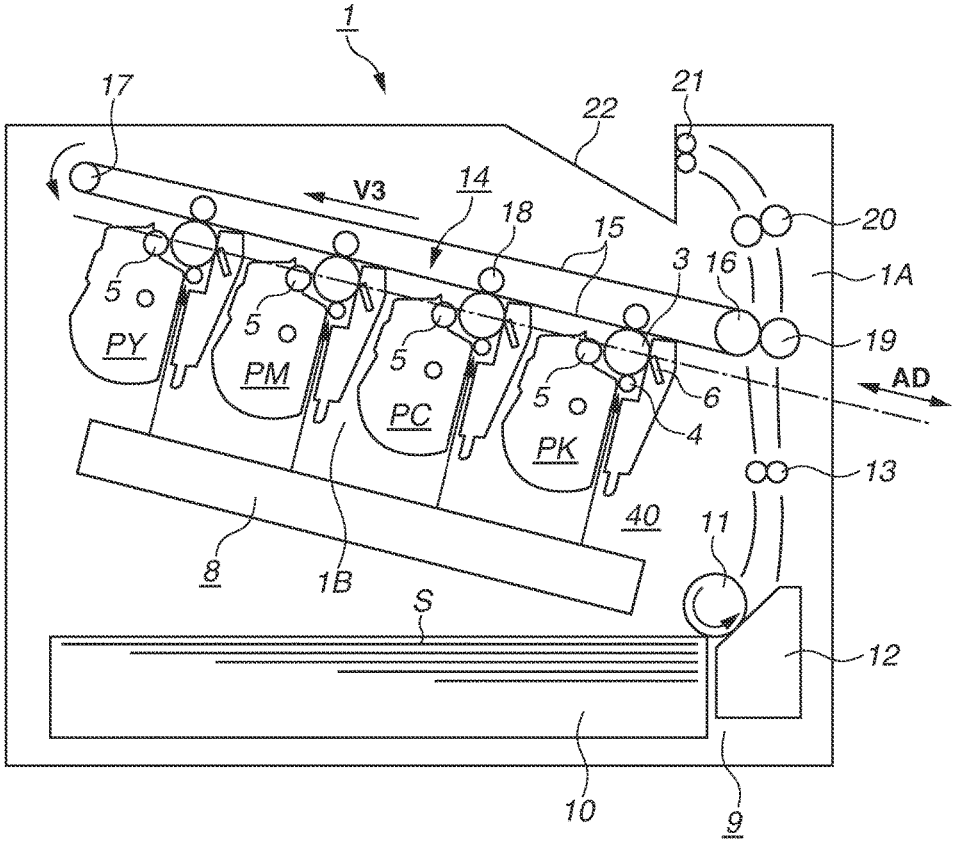
FIG. 1 is a sectional view schematically illustrating an image forming apparatus.
Figure 2:
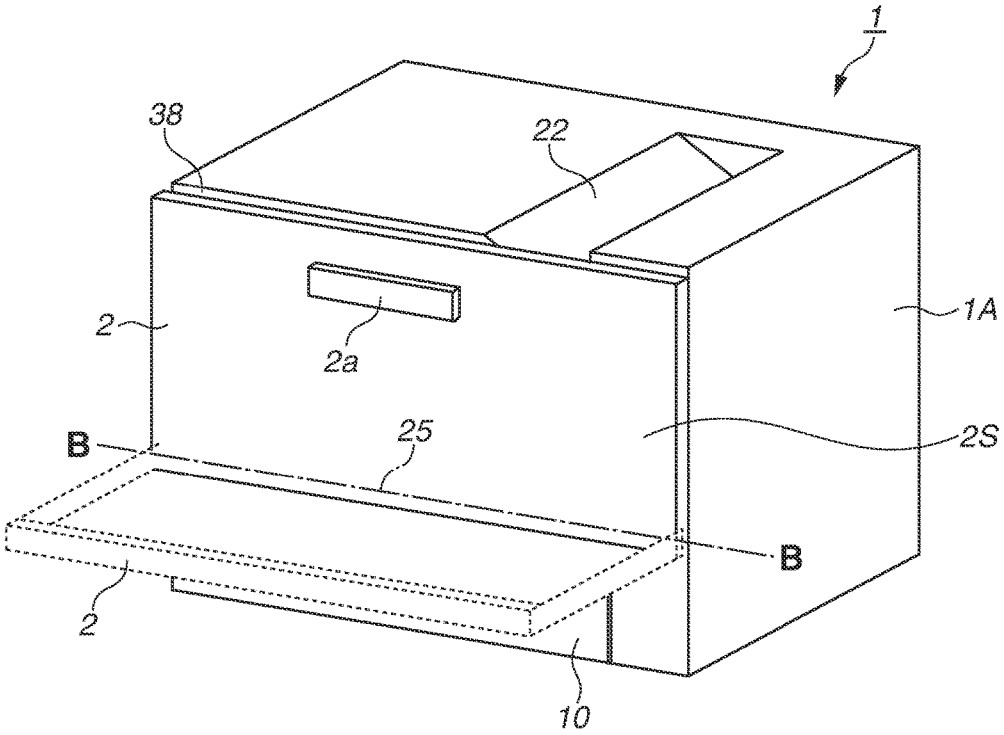
FIG. 2 is a perspective view illustrating an outer appearance of the image forming apparatus with a front door closed.
Figure 3:
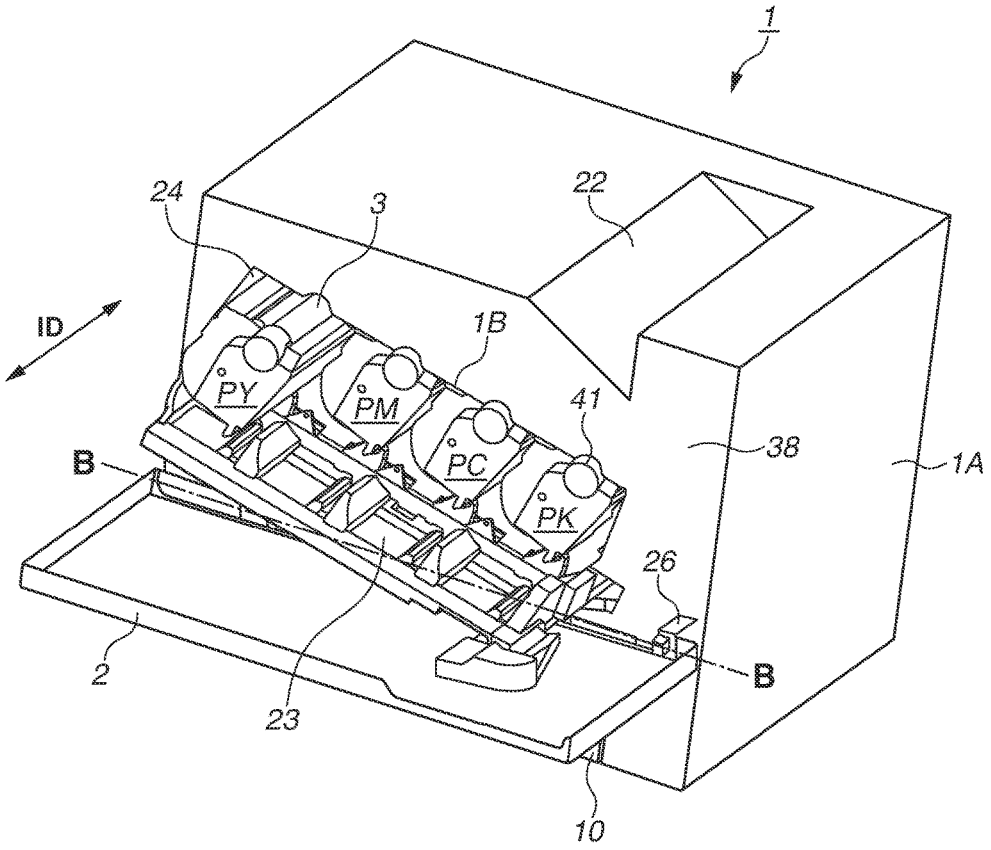
FIG. 3 is an perspective view illustrating an outer appearance of the image forming apparatus with the front door opened and a first cartridge pulled out halfway.

FIG. 1 is a vertical sectional view schematically illustrating an image forming apparatus 1 according to an exemplary embodiment. FIG. 2 is a perspective view illustrating an outer appearance of the image forming apparatus 1 with a front door (exterior cover) 2 closed. FIG. 3 is a perspective view illustrating an outer appearance of the image forming apparatus 1 with the front door 2 opened and a first process cartridge PY pulled out halfway.

The image forming apparatus 1 is a four-color full-color electrophotographic laser beam printer for forming a color image on a recording medium. The image forming apparatus 1 is of a cartridge mountable/removable type that uses four different process cartridges (hereinafter, referred to as cartridges) P. The process cartridges P include a first cartridge PY, a second cartridge PM, a third cartridge PC, and a fourth cartridge PK, which are removably mounted on an image forming apparatus main body 1A.

The front side of the image forming apparatus 1 according to the present exemplary embodiment refers to the side on which the front door 2 is disposed. The rear side or back side refers to the opposite side of the front side. The front-back direction refers to the direction directed from the back side toward the front side (forward direction) and the opposite direction (backward direction). The right and left refers to the right and left, respectively, when viewed from the front side of the image forming apparatus 1. The right-left direction refers to the direction directed from right to left (leftward direction) and the opposite direction (rightward direction). The image forming apparatus main body (hereinafter, referred to as an apparatus main body) 1A refers to portions of the image forming apparatus 1 other than the cartridges P. In the descriptions of the present exemplary embodiment, the longitudinal direction (LD) of the cartridge P is the direction parallel to the direction of the rotational axis (axial direction) of an electrophotographic photosensitive drum (hereinafter, referred to as a drum) 3 as a photosensitive member (image bearing member). With the cartridge P, the side to which a driving force is transmitted from the apparatus main body 1A in the longitudinal direction (LD) (the side on which the portion receiving the driving force from the apparatus main body 1A is disposed) is referred to as a driven side, and the opposite side of the drive side is referred to as a non-driven side.

A cartridge storage unit 1B for storing the cartridges P is disposed at the central portion in the apparatus main body 1A. The cartridge storage unit 1B is also a mounting unit for mounting the cartridges P by being inserted.

The cartridges P have a similar electrophotographic process mechanism, with different colors of the developing agent (hereinafter, referred to as toner) and different filling amounts of toner. In the cartridge storage unit 1B, each cartridge P mounted at an image formation position is provided with a rotational driving force transmitted from the apparatus main body 1A and supplied with biases including a charging bias and a development bias (not illustrated).

In a cartridge frame 40 of each cartridge P according to the present exemplary embodiment, a drum 3 and process units (a charging unit 4, a development unit 5, and a cleaning unit 6) for acting on the drum 3 are integrally assembled. A charging roller is used as the charging unit 4. A developing roller 45, which is a developing member, is used as the development unit 5. In a state where the cartridge P is mounted on the apparatus main body 1A and positioned, the direction of the rotational axis (axial direction) of the developing roller 45 is parallel to the axial direction of the drum 3. A cleaning blade is used as the cleaning unit 6. At the lower portion of each cartridge P, a laser scanner 8 is disposed as an image information exposure unit for the drum 3.

A feeding unit 9 is disposed under the laser scanner 8. The feeding unit 9 includes a sheet supplying cassette 10 for stacking and storing recording materials (transfer materials or final recording media) S, a feed roller 11, a separation unit 12, and a registration roller pair 13.

An intermediate transfer unit 14 is disposed above the four cartridges P. The intermediate transfer unit 14 is a primary transfer member for superimposing the toner images formed on the drums 3 of the first, the second, the third, and the fourth cartridges PY, PM, PC, and PK onto an intermediate transfer belt (a first recording medium, hereinafter referred to as a transfer belt) 15. The intermediate transfer unit 14 includes a driving roller 16 and a tension roller 17 which are parallelly disposed on the right-hand side and the left-hand side of the image forming apparatus 1. The flexible endless transfer belt 15 is stretched around the two rollers 16 and 17. The transfer belt 15 is disposed so as to be inclined with respect to the horizontal direction.

In the cartridge storage unit 1B, the upper surface of the drum 3 of each cartridge P mounted at an image formation position is in contact with the undersurface of a belt portion of the transfer belt 15 on the lower running side. The contact portion is a primary transfer portion. Inside the transfer belt 15, primary transfer rollers 18 are disposed to face the respective drums 3. In a state where the belt portions of the transfer belt 15 on the lower running side are in contact with the upper surfaces of all of the drums 3, the transfer belt 15 circularly driven by the driving roller 16 at the speed corresponding to the rotational speed of the drums 3 in the direction of the arrow V3. Each of the primary transfer rollers 18 are applied with a predetermined primary transfer voltage at a predetermined control timing. The driving roller 16 is in contact with a secondary transfer roller 19 via the transfer belt 15. The contact portion between the secondary transfer roller 19 and the transfer belt 15 is a secondary transfer portion. The secondary transfer roller 19 is applied with a predetermined secondary transfer voltage at a predetermined control timing.

A fixing unit 20 and a discharge unit 21 are disposed at the upper portion on the right-hand side of the apparatus main body 1A. The upper surface of the apparatus main body 1A serves as a discharge tray 22.

The cartridges PY, PM, PC, and PK are mounted side by side along the arrangement direction AD. In this case, the rotational axis of the drums 3 of the respective cartridges P are disposed on a straight line drawn by a dashed-dotted line illustrated in FIG. 1.

<Cartridge Configuration>

Figure 4:
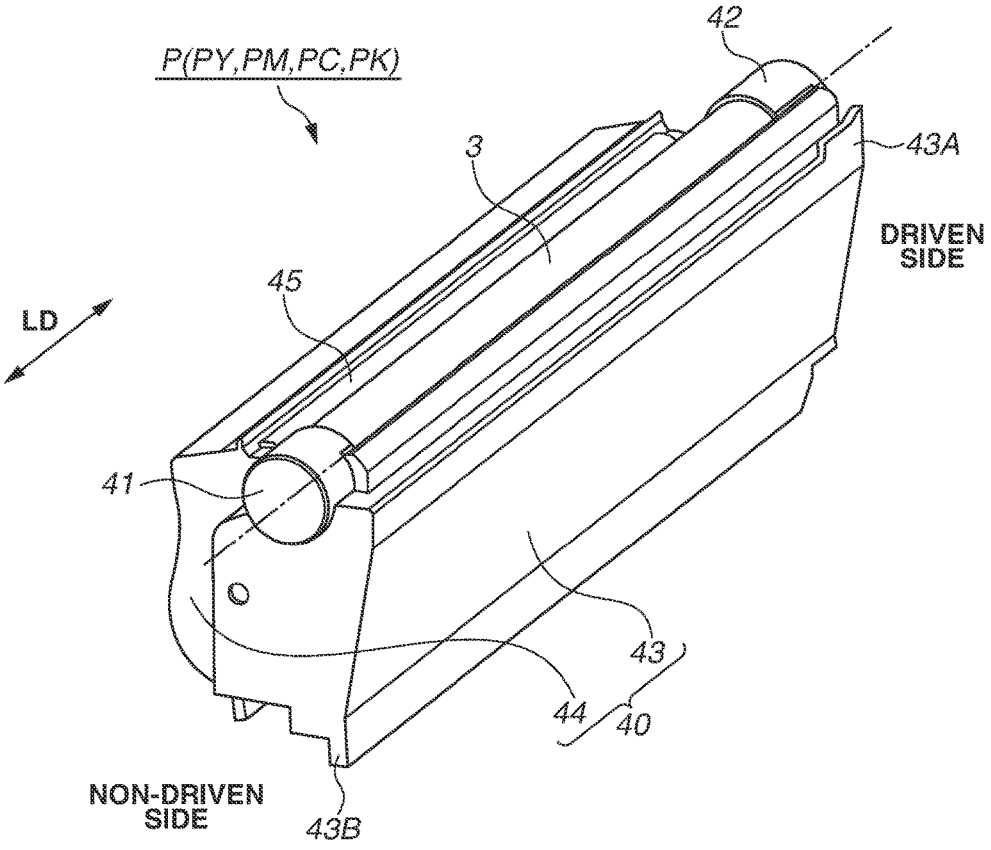
FIG. 4 is a perspective view illustrating an outer appearance of a process cartridge when viewed from a non-driven side.

FIG. 4 is a perspective view illustrating an outer appearance of the cartridge P viewed from the non-driven side. The cartridge P is an assembly having the axial direction of the drum 3 as the longitudinal direction. The cartridge frame 40 includes a cleaning unit 43 and a development unit 44. One end portion and the other end portion in the longitudinal direction (LD) of the drum 3 is rotatably supported by a first bearing member (non-driven side) 41 and a second bearing member (driven side) 42 disposed at the one end portion and the other end portion of the cleaning unit 43, respectively. The developing roller 45 is rotatably supported by the development unit 44. The development unit 44 includes a developer container for storing toner. A cartridge upper rib 43A is formed at the upper part on the rear side of the cleaning unit 43 in the longitudinal direction (LD). A cartridge lower rib 43B is formed at the lower part of the cleaning unit 43.

In the first cartridge PY, yellow (Y) toner is stored in the developer container, and a toner image of the Y color is formed on the surface of the drum 3. In the second cartridge PM, magenta (M) toner is stored in the developer container, and a toner image of the M color is formed on the surface of the drum 3. In the third cartridge PC, cyan C toner is stored in the developer container, and a toner image of the C color is formed on the surface of the drum 3. In the fourth cartridge PK, black (K) toner is stored in the developer container, and a toner image of the K color is formed on the surface of the drum 3.

<Methods for Replacing and Mounting Cartridge>

In the image forming apparatus according to the present exemplary embodiment, each cartridge P is replaced by front access, i.e., by opening a front door 2 as an opening/closing member of the apparatus main body 1A as illustrated in FIG. 3. A handle portion 2*a* is disposed at the front door 2. A sheet supplying cassette 10 is taken in and taken out by front access.

To take each cartridge P into the apparatus main body 1A and take the cartridge P out from inside of the apparatus main body 1A, the front side plate 38 of the apparatus main body 1A is provided with an opening 24 for allowing the passage of the cartridge P (an opening for mounting and removing the cartridge P). The direction of mounting and removing the cartridge P on/from the apparatus main body 1A is the axial direction of the drum 3.

The front side plate 38 of the apparatus main body 1A is provided with a front door 2 as an opening/closing member, which is movable between a close position at which the opening 24 is closed and an open position at which the opening 24 is open. A cartridge door 23 for allowing the cartridge P to be easily mounted on is disposed between the front door 2 and the front side plate 38. The cartridge door 23 is opened and closed interlocking with the front door 2.

In the present exemplary embodiment, the front door 2 can take an open state where the opening 24 is open and a closed state where the opening 24 is closed, by rotating the front door 2 around a horizontal door rotational axis (a first rotational axis) 25 (refer to FIG. 2) disposed at the bottom side of the front door 2. The door rotational axis 25 is rotatably supported by a bearing member 26 disposed on the front plate 38 of the apparatus main body 1A. In the present exemplary embodiment, the door rotational axis 25 is disposed with the axial direction horizontally extends in the right and left directions in consideration of door operability for the user. The front door 2 is closed so that a surface 2S covers the front side plate 38 of the apparatus main body 1A. The surface 2S can be changed from a rotation angle orientation in which the surface 2S is approximately parallel to the vertical direction, to another rotation angle orientation in which the surface 2S is approximately horizontally opened, with the door rotational axis 25 as a fulcrum, by turning the front door 2 about 90 degrees toward the front side of the front side plate 38.

Figure 5:
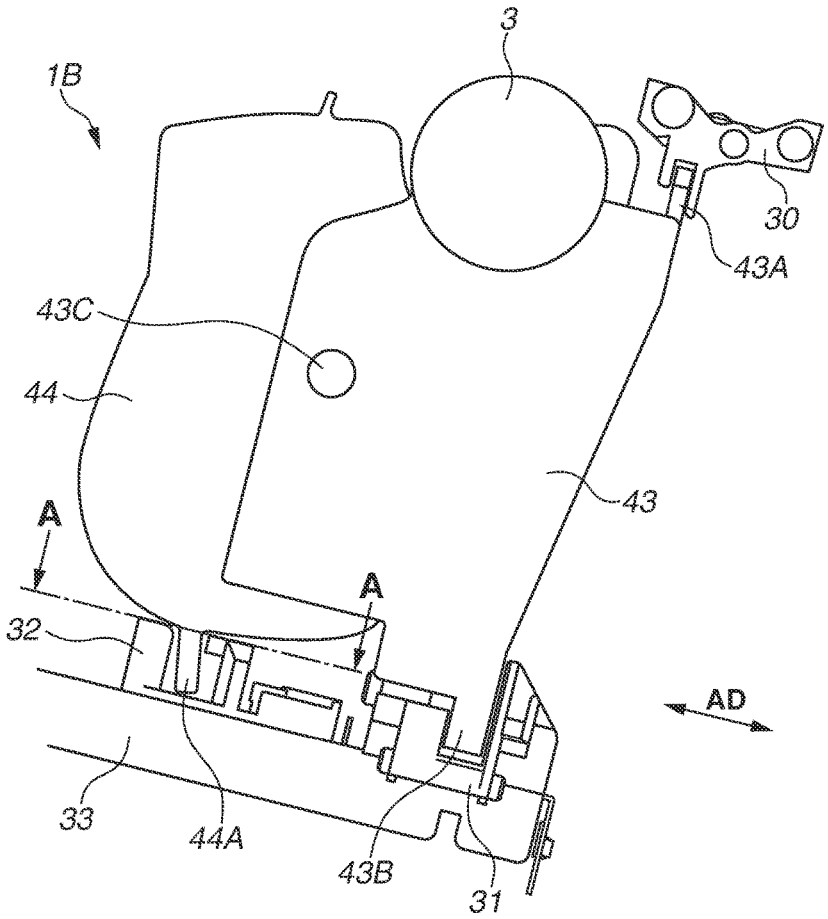
FIG. 5 illustrates a guide member of the cartridge.
Figure 6:
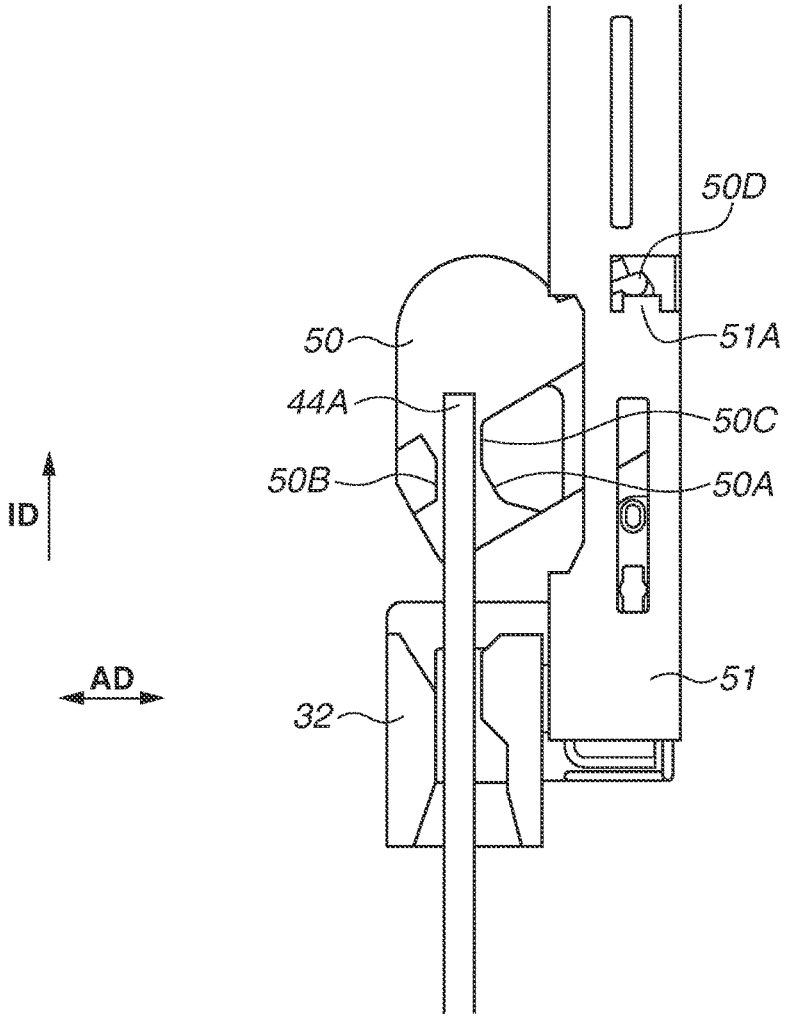
FIG. 6 is a cross-sectional view illustrating a guide configuration of a development unit taken along the A-A line illustrated in FIG. 5.

A method for mounting and removing the cartridge P will be described below with reference to FIGS. 3, 5, and 6. FIG. 5 illustrates each cartridge guide member when viewed from the axial direction of the drum 3. FIG. 6 is a cross-sectional view illustrating the guide configuration of the development unit 44 taken along the A-A line illustrated in FIG. 5. The cross-section taken along the A-A line (dashed-dotted line) illustrated in FIG. 5 is parallel to the arrangement direction AD of the cartridge P.

In the cartridge storage unit 1B of the apparatus main body 1A (inside the image forming apparatus main body 1A), there are disposed a cartridge upper guide 30, a cartridge lower guide 31, and a developing guide 32 for guiding each of the first, the second, the third, and the fourth cartridges PY, PM, PC, and PK while being mounted and removed.

When the cartridge P is inserted into the cartridge storage unit 1B, the cartridge upper rib 43A and the cartridge lower rib 43B are pinched by and inserted into the cartridge upper guide 30 and the cartridge lower guide 31 disposed on the apparatus main body 1A. The insertion direction ID as the moving direction of the cartridge P when the cartridge P is inserted into the cartridge storage unit 1B, is parallel to the longitudinal direction (LD) of the cartridge P mounted on the apparatus main body 1A. Although the development unit 44 is configured to be rotatable around a developing rotation center 43C, the development unit 44 is inserted with a pressed portion 44A regulated by the developing guide 32. In this way, the developing guide 32 regulates the movement of the development unit 44 in the direction perpendicularly intersecting with the insertion direction ID thereof. In the present exemplary embodiment, the direction perpendicularly intersecting with the insertion direction ID is the arrangement direction AD. When the cartridge P has been inserted into the cartridge storage unit 1B, the cartridge upper rib 43A and the cartridge lower rib 43B are held by holding portions (not illustrated) of the apparatus main body 1A.

FIG. 6 is a cross-sectional view illustrating a state where the cartridge P is being inserted halfway, taken along the A-A line illustrated in FIG. 5. The development unit 44 is regulated by the developing guide 32 in the early stage of insertion. After the development unit 44 passes the developing guide 32, the development unit 44 is regulated by pressing members 50 disposed at two different positions in the insertion direction ID and is inserted all the way to a predetermined position. Each of the pressing members 50 is provided with a developing regulation surface 50C, a first pressing surface (first pressing portion) 50B, and a second pressing surface (second pressing portion) 50A. The developing regulation surface 50C and the second pressing surface 50A are disposed to face the first pressing surface 50B in the arrangement direction AD via the pressed portion 44A of the development unit 44. The developing regulation surface 50C, the second pressing surface 50A, and the first pressing surface 50B regulate the movement of the pressed portion 44A of the cartridge P being inserted halfway into the cartridge storage unit 1B in the arrangement direction AD. In other words, the developing regulation surface 50C, the second pressing surface 50A, and the first pressing surface 50B are regulating portions for regulating the movement of the cartridge P in the direction perpendicularly intersecting with the insertion direction ID (i.e., arrangement direction AD according to the present exemplary embodiment). In other words, the second pressing surface 50A and the first pressing surface 50B constitute at least part of the regulating portion for regulating the movement of the cartridge P in the direction perpendicularly intersecting with the insertion direction ID. As is clear from FIG. 11, since the pressing member 50 is made of resin, the first pressing surface 50B and the second pressing surface 50A are configured to integrally move with the movement of the pressing member 50.

The pressing member 50 operates on a main stay 33 interlocking with the development unit 44 during the contact and separation operations of the cartridge P. Therefore, the pressing member 50 does not disturb the contact and separation operations. When the cartridge P has been inserted into the cartridge storage unit 1B, the pressed portion 44A and the developing guide 32 are set at different positions in the insertion direction ID. Therefore, the developing guide 32 does not disturb the contact and separation operations of the cartridge P (described below).

<Operation for Positioning Process Cartridge to Main Body>

Figure 7:
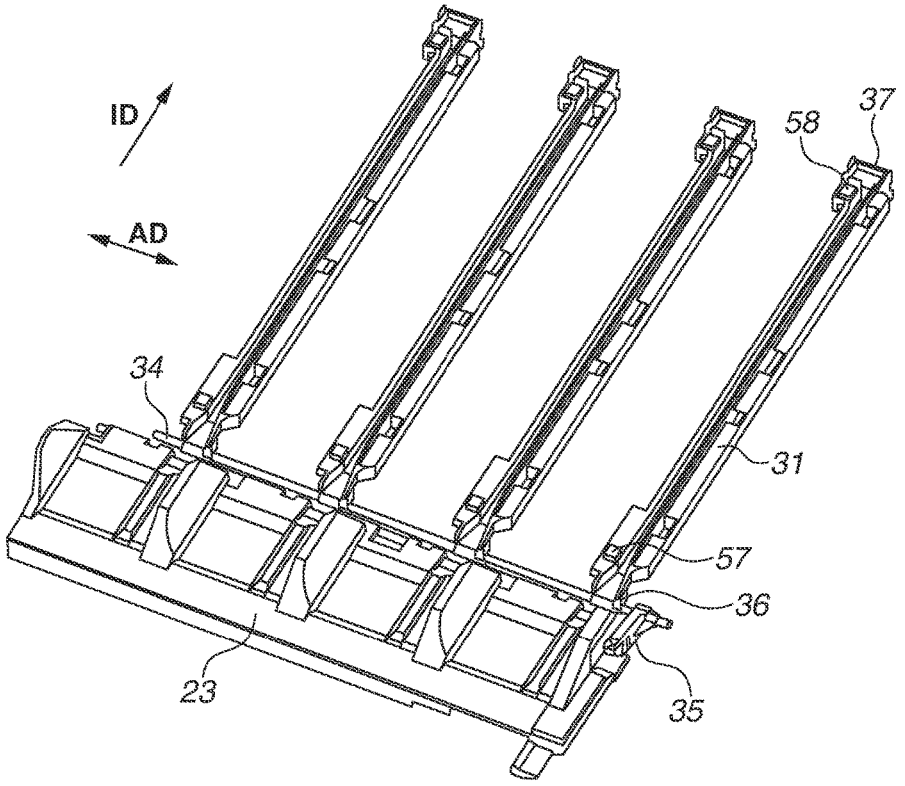
FIG. 7 illustrates an entire configuration of a positioning mechanism of the cartridge.

A positioning operation after the cartridge P has been inserted into the apparatus main body 1A will be described below. FIG. 7 illustrates an overall configuration of a positioning mechanism for the process cartridge P.

Figure 8:
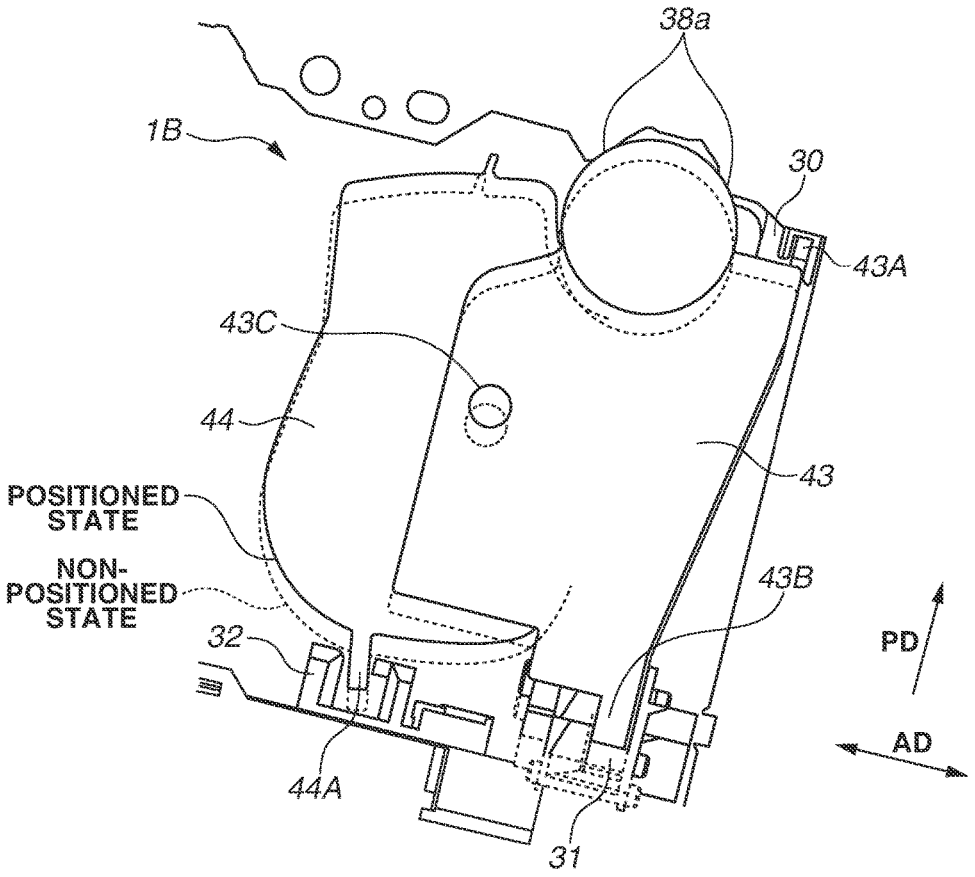
FIG. 8 illustrates a positioned state and a non-positioned state of the cartridge.

As described above, the cartridge door 23 is configured to rotate around the axis of a rail shaft 34 interlocking with the front door 2 (refer to FIG. 3). The rail shaft 34 is connected with the cartridge door 23 via a link lever 35, and rotates interlocking with the operation of the cartridge door 23. The cartridge lower guide 31 is attached to the rail shaft 34 via a front side rail arm 36. The cartridge lower guide 31 is also connected with a rear side rail arm 37 rotating in the same phase with the front side rail arm 36. Therefore, the cartridge lower guide 31 can move in the positioning direction PD interlocking with the front door 2. The positioning direction PD perpendicularly intersects with the arrangement direction AD and the insertion direction ID. FIG. 8 illustrates a positioned state and a non-positioned state of the cartridge P when viewed from the axial direction of the drum 3. Referring to FIG. 8, the solid lines indicate a state where the cartridge P has been positioned to the apparatus main body 1A (positioned state), and the dashed lines indicate a state where the cartridge P has been inserted into the cartridge storage unit 1B but has not been positioned to the apparatus main body 1A (non-positioned state).

After the cartridge P has been mounted on the apparatus main body 1A, when the user closes the front door 2, the cartridge lower guide 31 moves in the positioning direction PD (upward) interlocking with the close operation of the front door 2. The cartridge lower guide 31 is provided with a front side pressurizing portion 57 and a rear side pressurizing portion 58 (refer to FIG. 7) at two different positions in the insertion direction ID. The front side pressurizing portion 57 and the rear side pressurizing portion 58 upwardly pressurize the cartridge P to contact the cartridge P against each of the positioning portion 38*a* of the front side plate 38 and the positioning portion 39*a* of the rear side plate 39 (not illustrated) to position the cartridge P.

<Contact and Separation Mechanism and Operations of Main Body>

Figure 9:
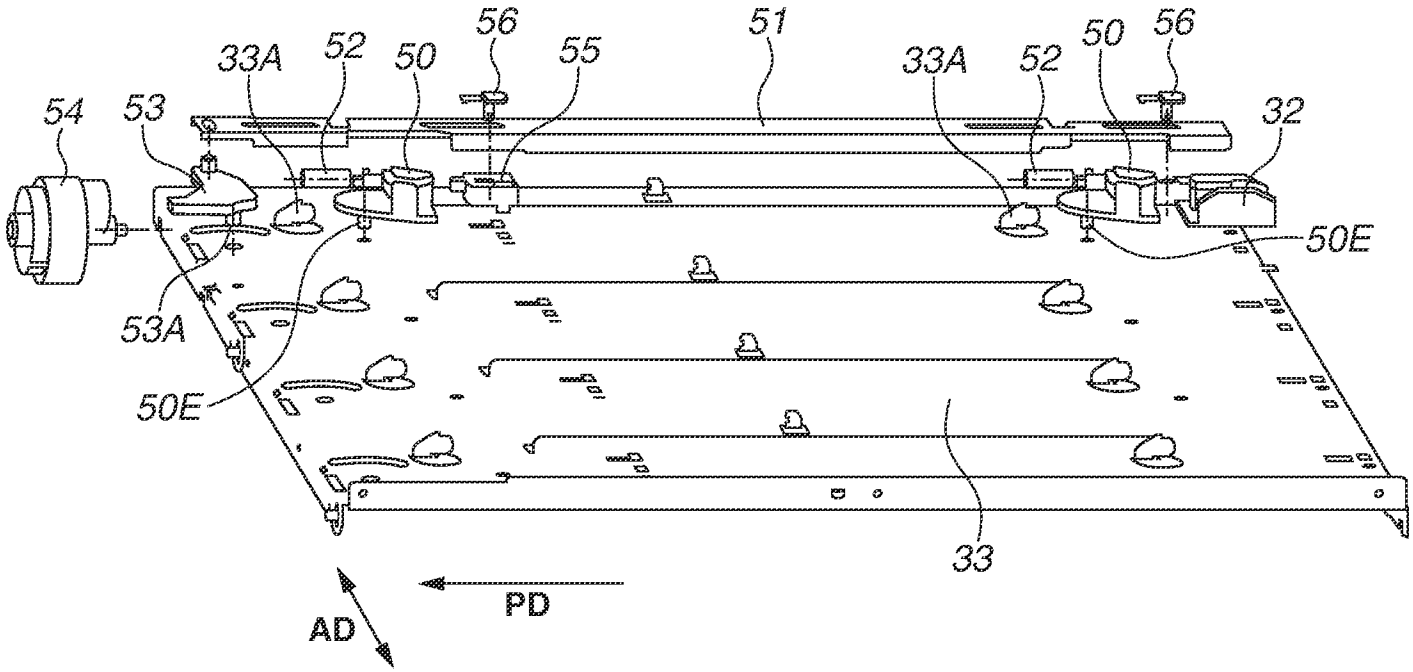
FIG. 9 illustrates an entire configuration of a contact and separation mechanism of an apparatus main body.
Figure 10A:
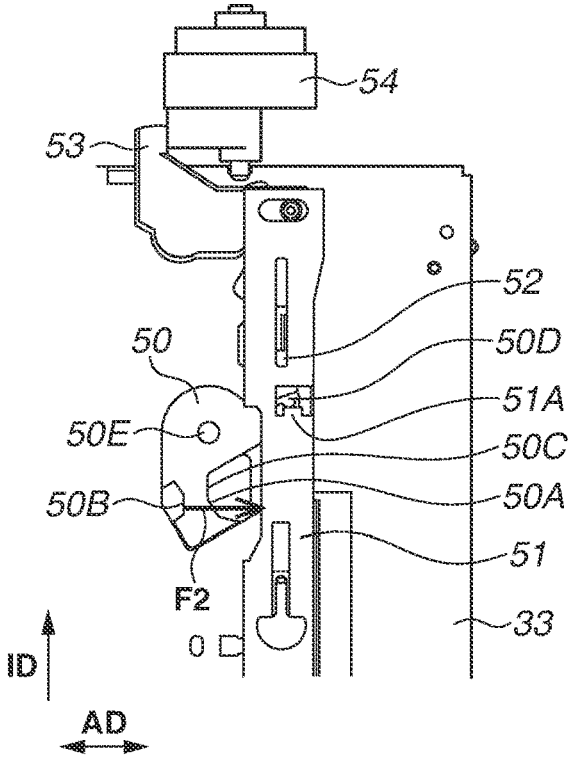
FIGS. 10A and 10B illustrate operations of the contact and separation mechanism of the apparatus main body.
Figure 10B:
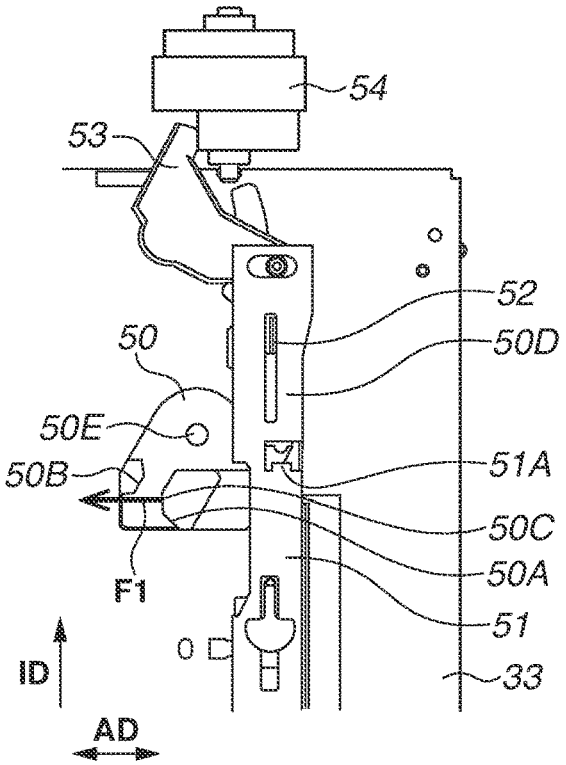
Figure 11:
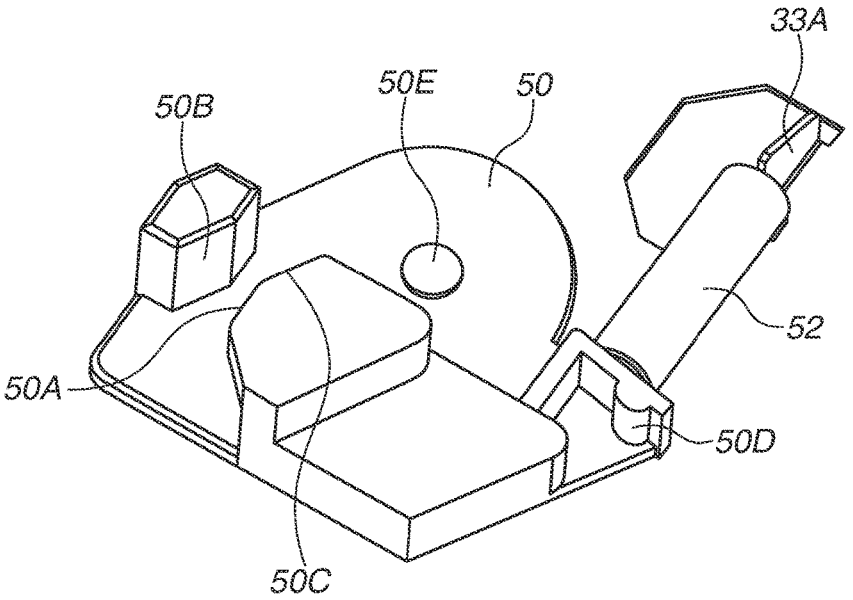
FIG. 11 illustrates details of a pressing member.

Next, the contact and separation mechanism provided in the apparatus main body 1A will be described with reference to FIGS. 9 to 11. FIG. 9 is an exploded perspective view illustrating an overall configuration of the contact and separation mechanism of the apparatus main body 1A. FIGS. 10A and 10B illustrate the contact and separation mechanism viewed from the opposite direction of the positioning direction PD. FIG. 11 is a perspective view illustrating details of the pressing member 50.

The contact and separation mechanism mainly includes the pressing member 50, a sliding member 51, a developing pressure spring 52, a separation lever 53, and a separation cam 54, which are all provided for each cartridge P. Therefore, the contact and separation mechanism corresponding to one cartridge P will be described below. The contact and separation mechanisms corresponding to other cartridges P have a similar configuration, and redundant descriptions thereof will be omitted. FIG. 9 illustrates only the contact and separation mechanism corresponding to the cartridge PK, and the illustration of the contact and separation mechanisms corresponding to other cartridges P will be omitted.

As illustrated in FIG. 9, the pressing member 50 is attached to be rotatable around a rotation boss 50E to two different positions disposed in line in the insertion direction on the main stay 33. The rotational axis of the pressing member 50 around which the pressing member 50 rotates about the rotation boss 50E is parallel to positioning direction PD. In other words, the rotational axis intersects (including orthogonal intersect) with the insertion direction ID. The sliding member 51 is attached onto the main stay 33 via the developing guide 32 and a slide bearing 55, and is slidable only in the insertion direction ID. The separation lever 53 is a member for connecting the separation cam 54 and the sliding member 51, and is rotatable around a rotation boss 53A on the main stay 33. The rotational axis of the separation lever 53 is parallel to the positioning direction PD. A hooking portion 50D of the pressing member 50 and a spring seat 33A on the main stay 33 are provided with the developing pressure spring (elastic member) 52.

The contact and separation mechanism takes two different positions: a contact position for bringing the cartridge P into the contact state and a separation position for bringing the cartridge P into the separation state. FIG. 10B illustrates a state where the contact and separation mechanism is at the contact position. In this state, the developing pressure spring 52 allows the second pressing surface (second pressing portion) 50A of the pressing member 50 to press the pressed portion 44A of the development unit 44 (refer to FIG. 8) in the direction of the arrow F1. FIG. 10A illustrates a state where the contact and separation mechanism is at the separation position. In this state, the first pressing surface 50B of the pressing member 50 can press the pressed portion 44A of the development unit 44 in the direction of the arrow F2 opposite to the direction of the arrow F1.

<Contact and Separation Operations of Cartridge>

The contact and separation operations of the cartridge P will be described in detail below with reference FIGS. 12A to 17C.

First, an operation for changing the state of the process cartridge P from the separation state to the contact state will be described with reference to FIGS. 12A to 14C. The separation state refers to a state where the developing roller 45 is separated from the drum 3 by a predetermined distance or more. The contact state refers to a state where the developing roller 45 is pressed to contact with the drum 3.

The intermediate state refers to a state where the developing roller 45 is separated from the drum 3 by shorter than the predetermined distance. The cartridge P passes the intermediate state when shifting between the contact state and the separation state. When the cartridge P is in the contact state, toner borne on the surface of the developing roller 45 can be made adhere to the surface of the drum 3, and a latent image formed on the drum 3 can be developed with the toner.

Figure 12A:
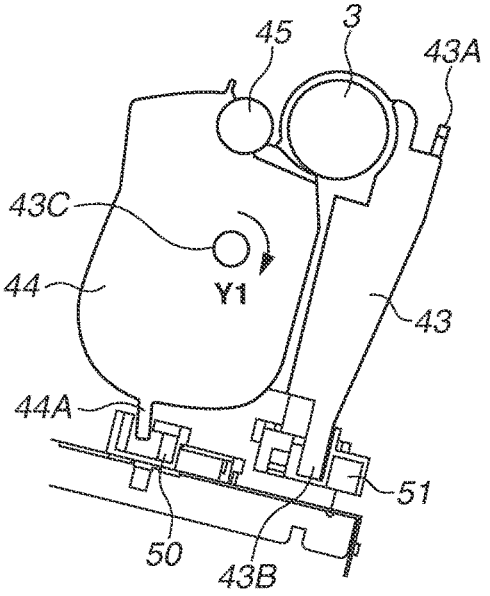
FIGS. 12A, 12B, and 12C illustrate a process in which the cartridge changes from a separation state to a contact state.
Figure 12B:
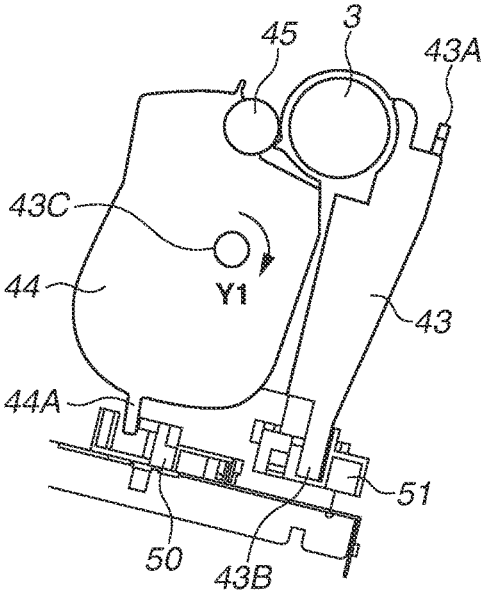
Figure 12C:
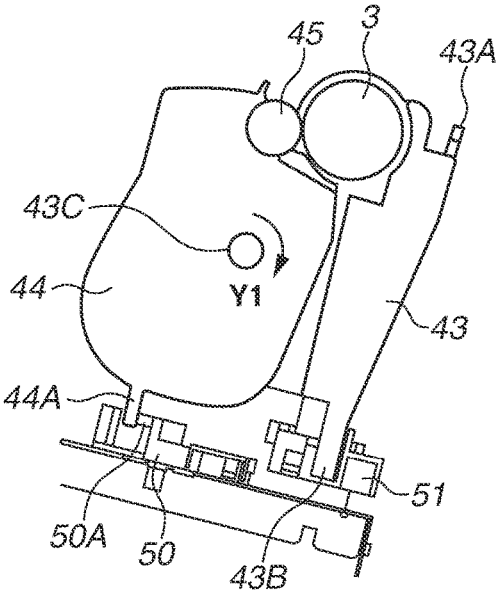
Figure 13A:
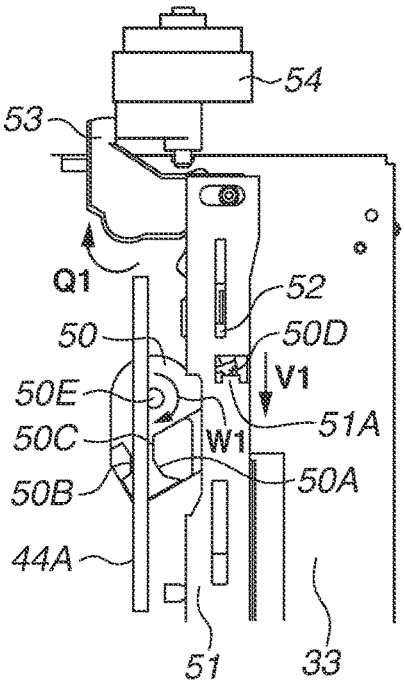
FIGS. 13A, 13B, and 13C illustrate a process in which the contact and separation mechanism of the apparatus main body changes from a separation state to a contact state.
Figure 13B:
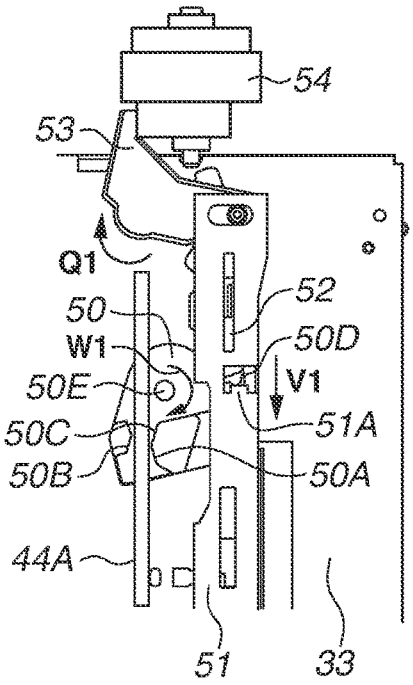
Figure 13C:
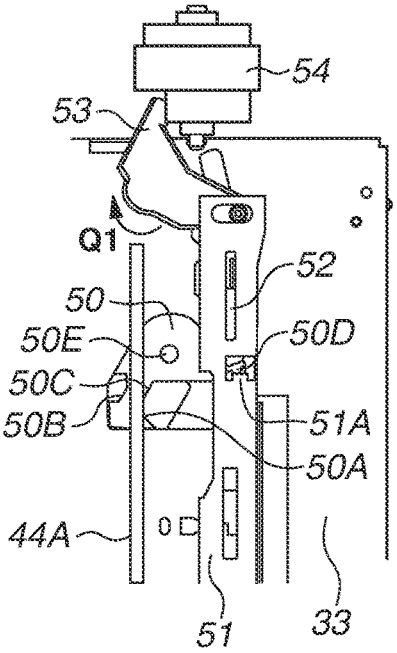
Figure 14A:
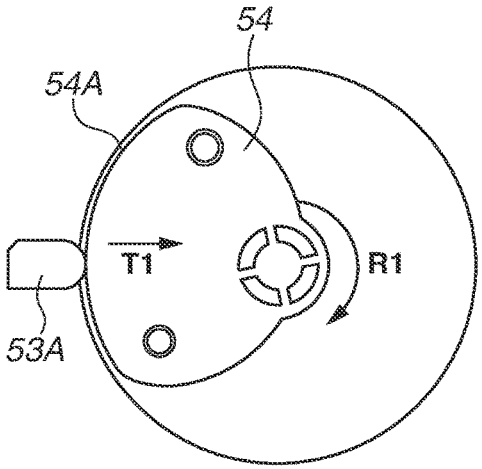
FIGS. 14A, 14B, and 14C illustrate a relationship between a separation lever and a separation cam during a state transition of the contact and separation mechanism from the separation state to the contact state.
Figure 14B:
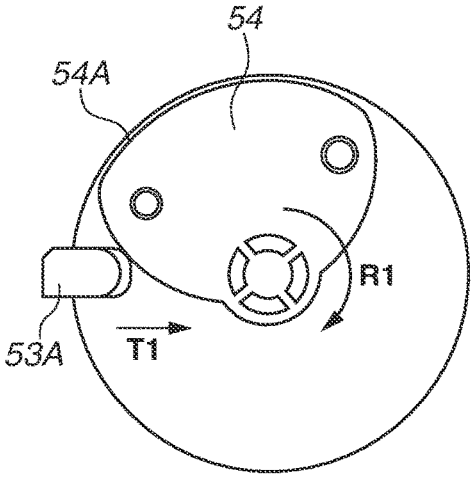
Figure 14C:
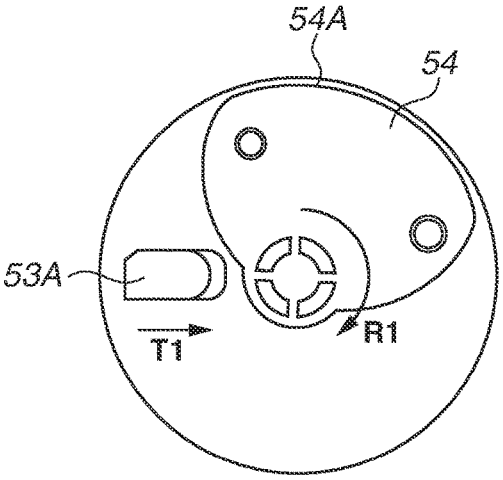

FIGS. 12A, 12B, and 12C illustrate a process in which the cartridge P transitions from the separation state to the contact state. FIG. 12A illustrates the separation state, FIG. 12B illustrates the intermediate state, and FIG. 12C illustrates the contact state. FIGS. 13A, 13B, and 13C illustrate a process in which the contact and separation mechanism transitions from the separation state to the contact state when viewed from the opposite direction of the positioning direction PD. FIG. 13A illustrates the separation state, FIG. 13B illustrates the intermediate state, and FIG. 13C illustrates the contact state. FIGS. 14A, 14B, and 14C illustrate a relationship between the separation lever 53 and the separation cam 54 during a state transition of the contact and separation mechanism from the separation state to the contact state when viewed from the insertion direction ID. FIG. 14A illustrates the separation state, FIG. 14B illustrates the intermediate state, and FIG. 14C illustrates the contact state.

In the separation states illustrated in FIGS. 12A, 13A, and 14A, the pressing member 50 is constantly urged in the direction of the arrow W1 by the pressurizing force of the developing pressure spring 52. A bending portion 51A of the sliding member 51 receives the pressurizing force of the developing pressure spring 52 from the hooking portion 50D of the pressing member 50, and is constantly urged in the direction of the arrow V1. Similarly, the separation lever 53 engaging with the sliding member 51 is constantly urged in the direction of the arrow Q1, and an arm 53A of the separation lever 53 is constantly urged in the direction of the arrow T1 illustrated in FIG. 14A to abut against the outer circumferential surface (cam surface) 54A of the separation cam 54. When the arm 53A abuts against the outer circumferential surface 54A and the position of the separation lever 53 is determined, the positions of the sliding member 51 and the pressing member 50 are also determined.

When a separation motor (not illustrated) is driven in the separation state, the separation cam 54 starts rotating in the direction of the arrow R1, as illustrated in FIG. 14B. When the separation cam 54 starts rotating, the arm 53A moves in the T1 direction while sliding on the outer circumferential surface 54A of the separation cam 54 by the pressurizing force of the developing pressure spring 52. Then, the separation lever 53 rotates in the direction of the arrow Q1 on the main stay 33, and the sliding member 51 slides in the direction of the arrow V1. At the same time, the pressing member 50 rotates in the direction of the arrow W1 on the main stay 33. Then, as illustrated in FIG. 12B, the second pressing surface 50A presses the pressed portion 44A of the development unit 44, and the development unit 44 rotates in the direction of the arrow Y1 around the rotation center 43C. When the separation cam 54 further rotates in the direction of the arrow R1 from this state, the developing roller 45 is brought into contact with the drum 3 with a predetermined contact pressure by the pressurizing force of the developing pressure spring 52 transmitted via the second pressing surface 50A, as illustrated in FIG. 12C. In the contact state, as illustrated in FIG. 14C, there is a predetermined gap between the separation cam 54 and the separation lever 53. This configuration enables converting the pressurizing force of the developing pressure spring 52 into a force for pressurizing the developing roller 45 onto the drum 3 with little loss.

Figure 15A:
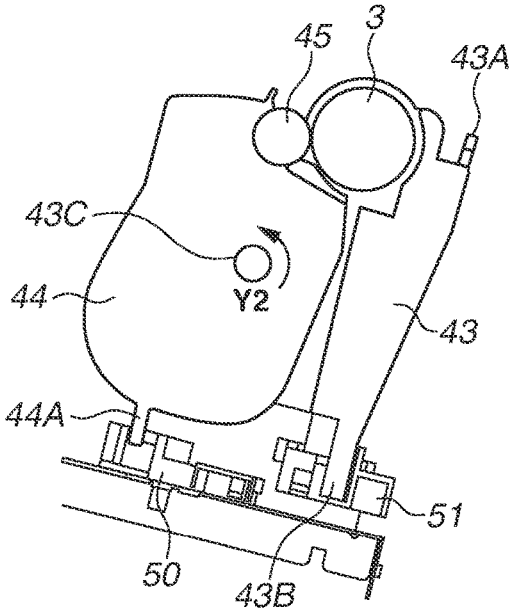
FIGS. 15A, 15B, and 15C illustrate a process in which the process cartridge changes from the contact state to the separation state.
Figure 15B:
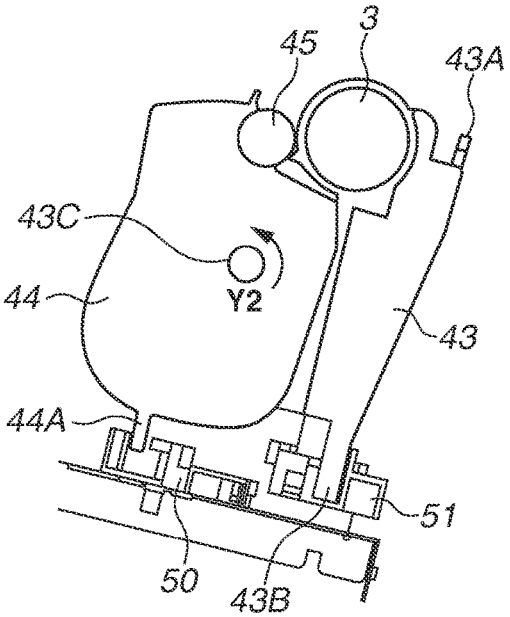
Figure 15C:
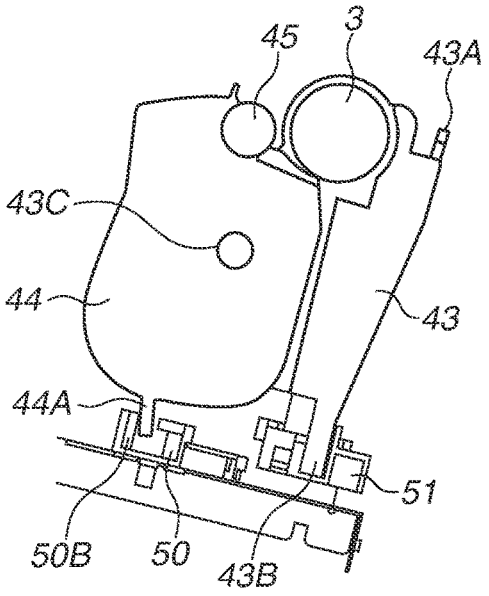
Figure 16A:
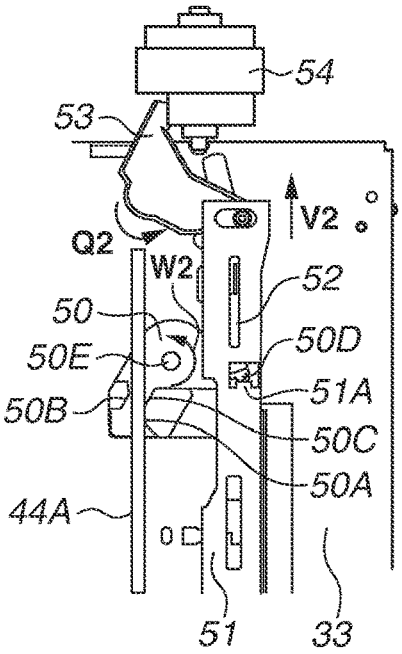
FIGS. 16A, 16B, and 16C illustrate a process in which the contact and separation mechanism of the apparatus main body changes from the contact state to the separation state.
Figure 16B:
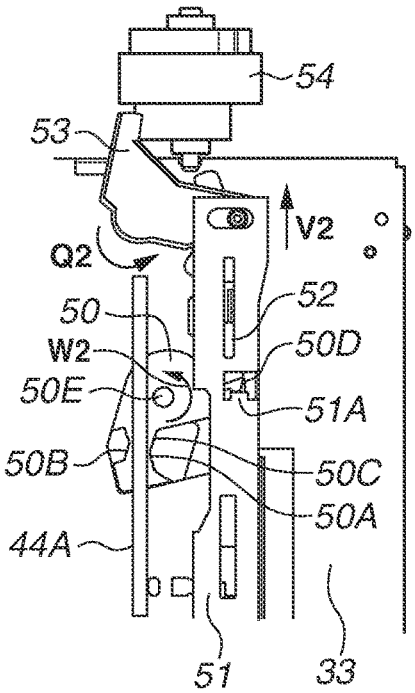
Figure 16C:
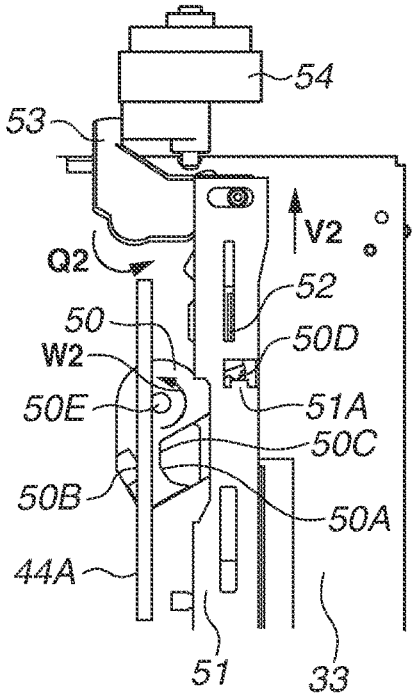
Figure 17A:
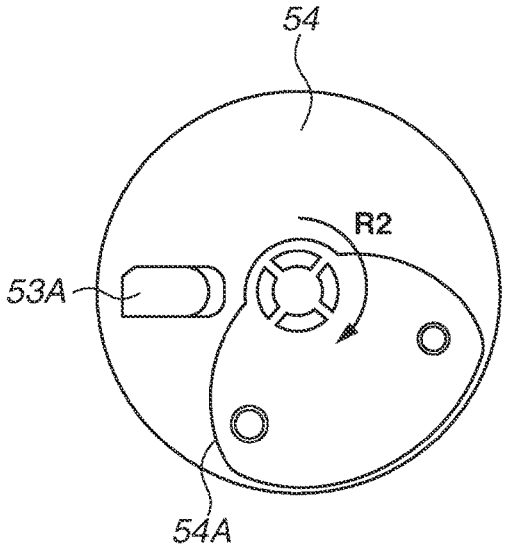
FIGS. 17A, 17B, and 17C illustrate a relationship between the separation lever and the separation cam during a state transition of the contact and separation mechanism from the contact state to the separation state.
Figure 17B:
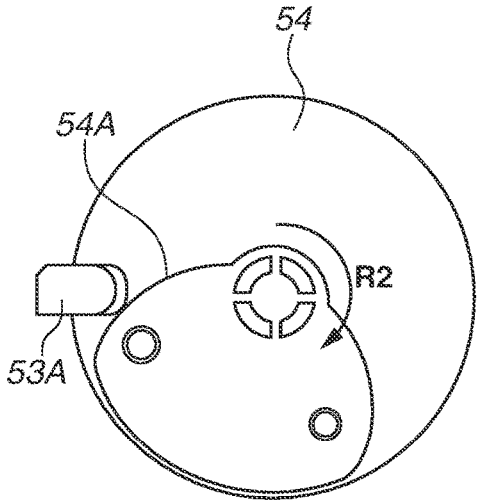
Figure 17C:
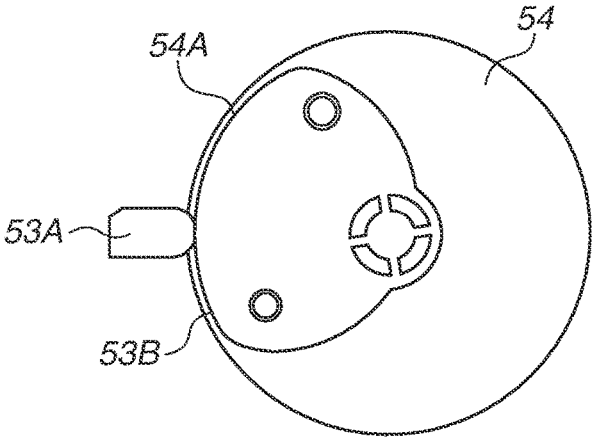

Next, operations for changing the cartridge P from the contact state to the separation state will be described with reference to FIGS. 15A to 17C. FIGS. 15A, 15B, and 15C illustrate a state transition of the cartridge P from the contact state to the separation state when viewed in the insertion direction ID. FIG. 15A illustrates the contact state, FIG. 15B illustrates the intermediate state, and FIG. 15C illustrates the separation state. FIGS. 16A, 16B, and 16C illustrates a process in which the contact and separation mechanism of the apparatus main body 1A transitions from the contact state to the separation state when viewed from the opposite direction of the positioning direction PD. FIG. 16A illustrates the contact state, FIG. 16B illustrates the intermediate state, and FIG. 16C illustrates the separation state. FIGS. 17A, 17B, and 17C illustrate a relationship between the separation lever 53 and the separation cam 54 in a process in which the contact and separation mechanism transitions from the contact state to the separation state when viewed from the insertion direction ID. FIG. 17A illustrates the contact state, FIG. 17B illustrates the intermediate state, and FIG. 17C illustrates the separation state.

When a motor (not illustrated) is driven in the contact state illustrated in FIGS. 15A, 16A, and 17A, the separation cam 54 starts rotating in the direction of the arrow R2 as illustrated in FIG. 17B. When the separation cam 54 starts rotating, the arm 53A of the separation lever 53 slides on a slope 54A of the separation cam 54, and the separation lever 53 starts rotating in the direction of the arrow Q2 on the main stay 33, as illustrated in FIG. 16B. Therefore, the sliding member 51 is pressed by the separation lever 53 to slide in the direction of the arrow V2. Accordingly, as illustrated in FIG. 15B, the pressing member 50 is pressed by the sliding member 51 to start rotating in the direction of the arrow W2 on the main stay against the urging force of the developing pressure spring 52. As a result, the first pressing surface 50B of the pressing member 50 presses the pressed portion 44A of the development unit 44, and the development unit 44 rotates in the direction of the arrow Y2 around the rotation center 43C. When the separation cam 54 further rotates from this state, the arm 53A of the separation lever 53 slides all the way to the outermost diameter surface 54B out of the outer circumferential surface 54A of the separation cam 54, the developing roller 45 separates from the drum 3 by a predetermined distance, and the separation of the developing roller 45 from the drum 3 is completed (the state illustrated in FIG. 15C), as illustrated in FIG. 17C.

As described above and as illustrated in FIGS. 12A, 12B, 12C, 15A, 15B, and 15C, the direction of the arrow Y1 and the direction of the arrow Y2 in which the development unit 44 moves from the separation state to the contact state and vice versa intersect with the insertion direction ID.

According to the present exemplary embodiment, the two pressing members 50 are disposed in line in the insertion direction ID for each cartridge P, and the two pressing members 50 are connected with one sliding member 51. Naturally, three or more pressing members 50 may be disposed for each cartridge P. If the pressing member 50 is configured so that the uniformity of the contact pressure and separation amount is unlikely to become uneven in the longitudinal direction of the developing roller 45, only one pressing member 50 is provided for each cartridge P. When two pressing members 50 are provided, two sliding members 51 corresponding to the two pressing members 50 may be provided instead of a configuration in which the two pressing members 50 are moved by one sliding member 51.

In the present exemplary embodiment, the cartridge P integrally mounts and removes the cleaning unit 43 and the development unit 44 on/from the apparatus main body 1A. However, the configuration of the cartridge P is not limited thereto. More specifically, the cartridge P may be configured so that only the development unit 44 can be removed from the apparatus main body 1A without removing the cleaning unit 43 from the apparatus main body 1A. For example, the development unit 44 as a first cartridge P1 and the cleaning unit 43 as a second cartridge P2 can be separately mounted on and removed from the apparatus main body 1A.

Figure 18A:
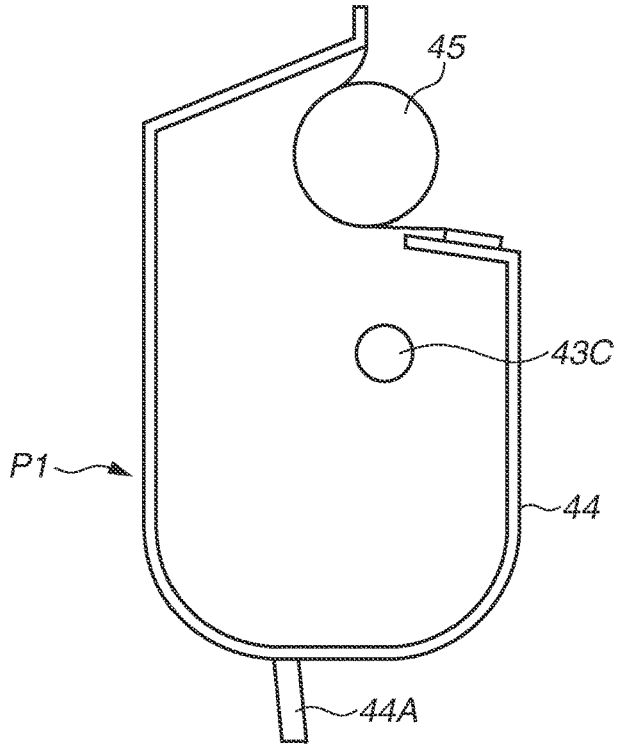
FIG. 18A and FIG. 18B are cross-sectional views schematically illustrating a first cartridge and a second cartridge, respectively.
Figure 18B:
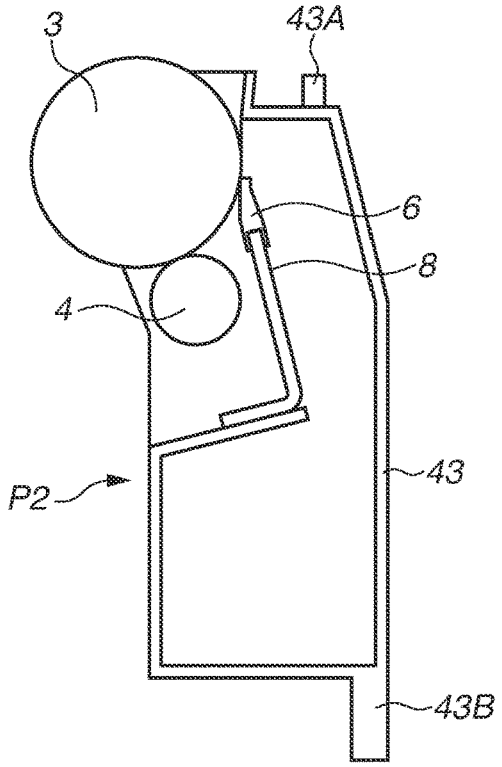

FIG. 18A is a sectional view schematically illustrating the first cartridge P1 viewed from of the direction of the rotational axis of the developing roller 45. FIG. 18B is a sectional view schematically illustrating the second cartridge P2 viewed from the direction of the rotational axis of the drum 3. The units having identical functions to those in the above-described exemplary embodiment are assigned the same reference numerals. When the first cartridge P1 is mounted on the apparatus main body 1A, the first cartridge P1 is rotatably held by holding portions (not illustrated) of the apparatus main body 1A centering on the developing rotation center 43C. When the second cartridge P2 is mounted on the apparatus main body 1A, the cartridge upper rib 43A and the cartridge lower rib 43B are held by holding portions (not illustrated) of the apparatus main body 1A.

According to the present exemplary embodiment, the pressing member 50 can press the cartridge P to separate the developing roller 45 from the drum 3 and press the cartridge P to bring the developing roller 45 into contact with the drum 3 by a predetermined pressure. Therefore, even if the cartridge P does not have an elastic member for bringing the developing roller 45 into contact with the drum 3, the developing roller 45 can be brought into contact with and separated from the drum 3. Naturally, the present exemplary embodiment is also applicable to a configuration in which the cartridge P has an elastic member for bringing the developing roller 45 into contact with the drum 3. In this case, the pressing force by the pressing member 50 can be obtained when bringing the developing roller 45 into contact with the drum 3. Therefore, it becomes possible to weaken the urging force of the elastic member compared with a configuration in which the developing roller 45 is brought into contact with the drum 3 only by the elastic member. Since the urging force can be weakened in this way, it becomes possible to use a smaller-sized elastic member or a lower-price elastic member than that in conventional cases.

When the development unit 44 is inserted, the pressing member 50 can restrict the movement of the development unit 44 in the direction perpendicularly intersecting with the insertion direction ID to guide the insertion. This enables reducing the number of regulation members (guide members) dedicated for regulation (guidance) as much as possible, and therefore, the cost and size of the image forming apparatus can be reduced. Particularly in a configuration in which the cleaning unit 43 and the development unit 44 can be separately removed from the apparatus main body 1A, it is necessary to regulate the cleaning unit 43 and the development unit 44. In this case, therefore, the present exemplary embodiment is more effective in reducing the cost and size of the image forming apparatus.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An image forming apparatus comprising:

a photosensitive cartridge including a photosensitive member;

a developing cartridge including a developing member; and a main body having a mounting unit which is configured to mount the photosensitive cartridge and the developing cartridge by moving the developing cartridge and the photosensitive cartridge in an insertion direction;

wherein the photosensitive cartridge and the developing cartridge are detachably mountable to the mounting unit, respectively, wherein the main body includes:

a moving member configured to move the developing cartridge between a contact position where the developing member contacts with the photosensitive member and a separate position where the developing member does not contact with the photosensitive member, and an elastic member configured to press the moving member so that the developing cartridge moves toward the contact position from the separate position.

2. The image forming apparatus according to claim 1, the moving member including:

a first pressing portion configured to press the developing cartridge mounted on the mounting unit to separate the developing member from a photosensitive member, and a second pressing portion configured to press the developing cartridge mounted on the mounting unit to bring the developing member into contact with the photosensitive member.

3. The image forming apparatus according to claim 2, wherein, the first and the second pressing portions integrally moving with a movement of the moving member.

4. The image forming apparatus according to claim 2, wherein, the second pressing portion moves the developing cartridge towards the contact position by the elastic member.

5. The image forming apparatus according to claim 2, wherein the moving member has a regulating portion configured to regulate a movement of the developing cartridge in a direction perpendicularly intersecting with the insertion direction while the developing cartridge is being moved in the insertion direction and inserted into the mounting unit.

6. The image forming apparatus according to claim 5, wherein the first pressing portion constitutes at least a part of the regulating portion.

7. The image forming apparatus according to claim 5, wherein the second pressing portion constitutes at least a part of the regulating portion.

8. The image forming apparatus according to claim 5, wherein the regulating portion has a regulation surface different from the first and the second pressing portions.

9. The image forming apparatus according to claim 1, wherein the insertion direction is a direction along a longitudinal direction of the developing member.

10. The image forming apparatus according to claim 1, wherein the insertion direction is a direction intersecting with a moving direction in which the developing cartridge moves between the separate position and the contact position.

11. The image forming apparatus according to claim 2, further comprising a pressing member including another first pressing portion configured to press the developing cartridge mounted on the mounting unit towards the separate position, and another second pressing portion configured to press the developing cartridge mounted on the mounting unit towards the contact position, wherein the moving member and the pressing member are disposed in line in the insertion direction.

12. The image forming apparatus according to claim 2, wherein the moving member moves between a first position for pressing the developing member from the contact position towards the separate position with the first pressing portion, and a second position for pressing the developing member from separate position towards the contact position with the second pressing portion, and wherein the moving member moves between the first and the second positions by rotating around an axis intersecting with the insertion direction.

13. An image forming apparatus comprising:

a photosensitive cartridge including a photosensitive member;

a developing cartridge including a developing member;

a main body having a mounting unit which is configured to mount the photosensitive cartridge and the developing cartridge;

wherein the photosensitive cartridge and the developing cartridge are detachably mountable to the mounting unit, respectively, wherein the main body includes:

a moving member configured to move the developing cartridge between a contact position where the developing member contacts with the photosensitive member and a separate position where the developing member does not contact with the photosensitive member, and a regulating portion disposed on the moving member, and configured to regulate a movement of the developing cartridge in a direction perpendicularly intersecting with the insertion direction while the developing cartridge is being moved in the insertion direction and inserted into the mounting unit.

14. The image forming apparatus according to claim 13, the moving member including:

a first pressing portion configured to press the developing cartridge mounted on the mounting unit to separate the developing member from a photosensitive member, and a second pressing portion configured to press the developing cartridge mounted on the mounting unit to bring the developing member into contact with the photosensitive member.

15. The image forming apparatus according to claim 14, wherein, the first and the second pressing portions integrally moving with a movement of the moving member.

16. The image forming apparatus according to claim 14, wherein, the second pressing portion moves the developing cartridge towards the contact position by the elastic member.

17. The image forming apparatus according to claim 14, wherein the first pressing portion constitutes at least a part of the regulating portion.

18. The image forming apparatus according to claim 14, wherein the second pressing portion constitutes at least a part of the regulating portion.

19. The image forming apparatus according to claim 14, wherein the regulating portion has a regulation surface different from the first and the second pressing portions.

20. The image forming apparatus according to claim 13, wherein the insertion direction is a direction along a longitudinal direction of the developing member.

21. The image forming apparatus according to claim 13, wherein the insertion direction is a direction intersecting with a moving direction in which the developing cartridge moves between the separate position and the contact position.

22. The image forming apparatus according to claim 14, further comprising a pressing member having another first pressing portion configured to press the developing cartridge mounted on the mounting unit towards the separate position, and another second pressing portion configured to press the developing cartridge mounted on the mounting unit towards the contact position, wherein the moving member and the pressing member are disposed in line in the insertion direction.

23. The image forming apparatus according to claim 14, wherein the moving member moves between a first position for pressing the developing member from the contact position towards the separate position with the first pressing portion, and a second position for pressing the developing member from separate position towards the contact position with the second pressing portion, and wherein the moving member moves between the first and the second positions by rotating around an axis intersecting with the insertion direction.

* * * * *